United States Patent [19]

Sonnenschein et al.

[11] Patent Number: 4,622,183

[45] Date of Patent: Nov. 11, 1986

[54] DEVICE FOR TRANSFERRING COOLING WATER OF A WET OR WET/DRY COOLING TOWER TO RECIRCULATION MEANS

[75] Inventors: Hans Sonnenschein, Essen; Paul Paikert, Witten, both of Fed. Rep. of Germany

[73] Assignee: Gea Luftkühlergesellschaft Happel GmbH & Co., Bochum, Fed. Rep. of Germany

[21] Appl. No.: 738,731

[22] Filed: May 29, 1985

[30] Foreign Application Priority Data

May 29, 1984 [EP] European Pat. Off. ..... 84710018.7

[51] Int. Cl.[4] ..... B01F 3/04

[52] U.S. Cl. ..... 261/110; 165/60; 165/900; 261/DIG. 11; 261/DIG. 85

[58] Field of Search ..... 261/110–112, 261/151, DIG. 11, DIG. 85; 165/60, DIG. 1, 900

[56] References Cited

U.S. PATENT DOCUMENTS

| | | | |
|---|---|---|---|
| 2,915,302 | 12/1959 | Jacir | 261/110 X |
| 2,917,292 | 12/1959 | Hittrich | 261/112 X |
| 3,151,675 | 10/1964 | Lysholm | 261/112 X |
| 3,286,999 | 11/1966 | Takeda | 261/DIG. 11 |
| 3,415,502 | 12/1968 | Munsters | 261/DIG. 11 |
| 4,202,847 | 5/1980 | Ernst et al. | 261/112 X |
| 4,385,010 | 5/1983 | Bosne | 261/DIG. 11 |
| 4,459,244 | 7/1984 | Norback | 261/DIG. 11 |
| 4,521,350 | 6/1985 | Lefevre | 261/DIG. 85 |

FOREIGN PATENT DOCUMENTS

| | | | |
|---|---|---|---|
| 167933 | 8/1950 | Austria | 261/112 |
| 308290 | 10/1918 | Fed. Rep. of Germany | 261/DIG. 11 |
| 678100 | 7/1939 | Fed. Rep. of Germany | 261/112 |
| 2619407 | 11/1977 | Fed. Rep. of Germany | . |
| 876525 | 11/1942 | France | 261/112 |

*Primary Examiner*—Richard L. Chiesa

*Attorney, Agent, or Firm*—Michael J. Striker

[57] ABSTRACT

In a wet type or wet/dry type cooling tower, water discharged from water distributing means after its passage cooling air heat exchanger is intercepted by an array of parallel water guiding plates. Each guiding plate has a sloping upper part which covers the gap between opposite plates and an upright lower part defining a substantially horizontal transition region with the upper part. A plurality of inclined channel like embossments is formed in the upright lower part. The embossments extend one above the other between a lateral edge of the upright lower part and the transition region. At least one water collecting channel extends in transverse direction along the lateral edges of the upright lower part to collect water discharged from the inclined embossments and transfer the collected water to a recirculation device. This arrangement provides a passage for the upward stream of cooling air which is not unduly restricted by the water collecting channels and the pressure loss of cooling air stream is minimized.

19 Claims, 10 Drawing Figures

DEVICE FOR TRANSFERRING COOLING WATER OF A WET OR WET/DRY COOLING TOWER TO RECIRCULATION MEANS

BACKGROUND OF THE INVENTION

The present invention relates in general to wet cooling towers or to wet/dry cooling towers and in particular to a device for transferring cooling water of such towers after its heat exchange with cooling air in a recirculating means which returns cool water to a distributing installation at the top of the tower. Wet cooling towers or wet sections of wet/dry cooling towers are conventionally designed in such a manner that cooling water after discharge from heat exchanging elements for example of built-in scrubbing units, freely flows by the force of gravity into an underlying collecting basin from which it is pumped up back in the water distributing device. In this arrangement the space below the heat exchanging elements, the so-called rain zone through which cooling air streams upwards to the cooling elements, causes about 20 to 40% of the total pressure loss. On the other hand, in the rainy zone only 10% maximum of the total heat transfer takes place. In addition, because of the height of fall of the cool water which corresponds approximately to the height of the cooling air stream, the requisite pumping installations consume approximately 0.5% of the total electrical output of the power station.

On the basis of this knowledge, attempts have been already made to reduce the dimension of the height of the cooling air stream so as to reduce operational costs which are affected by the size of the stream of cooling air. This measure however has the disadvantage that the reduced height of the air inflow causes a non-uniform throughflow in the cooling tower and, to achieve the efficiency attainable at a larger air stream height the tower must have been constructed substantially higher.

The problems encountered in designs using different heights of the cooling air stream (increased height of the air stream causes higher operational costs, while lower height of the air stream causes higher investment costs due to increased height of the tower) can be avoided if a solution is found how to fetch and collect the cool water immediately below the heat exchanging elements. In this case, independently from the geodetical level of installation of the heat exchanging elements, the requisite efficiency of the transfer would be practically always of the same magnitude namely of that corresponding to the least imaginable pressure head.

A prior art suggestion in this direction is known from the Cerman publication DE-OS No. 26 19 407. In this design, there are employed water guiding plates of a wave shaped vertical cross-section acting as scrubber plates and being provided in the range of their lower edge with water collecting channels extending in longitudinal direction of the plates whereby the channels can be arranged unilaterally or at both sides of the plates or superposed vertically one above the other. Since all cooling water drizzles down on the water guiding plates and is caught in collecting channels, free cross-sectional area available for the stream of cooling air flowing up from below between the water collecting channels is limited to a size which amounts maximum to about one quarter to one half of the total used for cross-sectional area of the tower. This limitation is generally independent on the shape of the water guiding plates and of the water collecting channels. Due to the fact that the water collecting channels drastically constrict the cross-section for the throughflow of the cooling air, the effective share of the throughflow cross-section is substantially below 15%. This reduced inflow cross-section in turn causes additional pressure losses which would require larger cooling towers and increased investment costs.

SUMMARY OF THE INVENTION

It is, therefore, a general object of the present invention to overcome the aforementioned disadvantages.

In particular, it is an object of this invention to provide such an improved device for transferring cooling water in wet or wet/dry cooling towers in which the cross-section for the throughflow of cooling air in the range of water guiding plates is substantially increased and consequently pressure losses in the air stream are effectively reduced.

In keeping with these objects and others which will become apparent hereinafter, one feature of the invention resides, in a device for transferring cooling water of the aforedescribed kind, in a combination which comprises a plurality of guiding plates arranged side-by-side below a cooling air heat exchanger to guide water discharged from the latter, the guiding plates having, respectively a sloping upper part, an upright lower part and a substantially horizontal bending line between the two parts, at least one set of parallel channel-like embossments formed in each upright lower part and extending between said bending line and a lateral edge of said lower part, said sloping upper part covering the gap between opposite guiding plates, and a plurality of water collecting channels arranged one above the other transversely to said guiding plates at the lateral edges thereof to collect and recirculate water discharged from said embossments.

By virtue of this construction, cool water emanating from the heat exchanging elements immediately drops on the inclined upper parts of the water guiding plates and is transferred therefrom in thin layers on vertically directed surfaces of the lower parts and enters the elongated downwardly inclined channel-like embossments. Concept of this channel-like embossments is such that natural surface tension of the water layers is sufficient to counteract the force of gravity and transfer the water layers in the inclined parallel channel-like embossments which decline to the transversely directed water collecting channels. The combined cross-sections of all channel-like embossments on a water guiding plate is of course adjusted to the maximum water layer accrued on each guiding plate. Due to the deflection of the thin water layers on the upper part of the guiding plates and due to their lateral drain along the embossments into water collecting channels which extend transversely to the area of guiding plates outside their lateral edges, the effective cross-section available for the inflow of cooling air is not restricted. Consequently, the advantage is obtained that the total resistance to the air flow is reduced and the height of the cooling tower can be also reduced inasmuch the resistance of the rain zone below the built-in installations is eliminated. Moreover, the height of delivery of pumps used for recirculating the collected water into the top water distributing insulation, can be also substantially reduced. Free space below the water guiding plates can now be designed with such dimensions which are required for an optimum inflow of cooling air. An additional advantage results due to the considerably reduced noise level. Consequently, measures for suppressing noise which hitherto have required considerable expenditures, can be dispensed with.

In the preferred embodiment of this invention, the upper end portions of the channel-like embossments opening in the sloping upper part of the guiding plates, are directed vertically so as to improve the transfer of cooling water from the inclined run off surfaces. These end portions can be made relatively short and transit with correspondingly small radii of curvature in the inclined embossments.

In most cases it suffices when the upper ends of the inclined channel-like embossments are arranged along the bending or transition line between the upper and lower parts of the guiding plates. In certain instances it may be of advantage when the end portions extend up through the inclined upper part. In another modification it is also possible to extend the inclined portion of the channel-like embossments as far as to the inclined upper part of the guiding plates.

In order to improve the drainage of water layers from the channel-like embossments the latter are inclined to a horizontal at an angle between 15° to 45°, preferably at an angle of 20° at which optimum flow conditions are created.

In one embodiment of this invention, the channel-like embossments are kept unilaterally in the upright part of the water guiding plates. Even in this embodiment, the result channel-like embossments on both opposite sides of these plates which permit the run off of water layers from both sides of the guiding plates into the lateral water collecting channels.

The configuration of the vertical cross-section of the channel-like embossments can be arbitrary. In the preferred embodiment however which improves the drainage while maintaining sufficient adhesion against gravity is the cross-section having square or rounded shape. Preferably, the cross-section has a sinusoidal or meandering form. Preferably, there are provided at least two water collecting channels extending transversely one above the other at the lateral edges of the water collecting plates. In this manner the distance between the outer sides of the water collecting channels can be reduced and the useful cross-section for the air stream increased. The size of each water collecting channel in this case is adjusted to the expected amount of water discharged from the assigned part of channel-like embossments. Accordingly, the water collecting channels can be designed with a flatter configuration. Moeover, there results a possibility that separate pumps can be provided for water collecting channels arranged at the same level and the output and size of these pumps can be accommodated to the corresponding quantity of collected water. By these measures further improvements with regard to the pressure head or delivery height can be achieved and a corresponding savings of energy obtained.

In order to direct water from the inclined upper part of guiding plates to both upper surfaces of the upright lower part, the inclined upper part is provided in the range of the bending line with openings for example in the form of downwardly stamped bosses or upwardly stamped tongue-like sections.

The transition regions between the upper and lower parts in the range of the bending line are either rounded or in the form of a sharp edge. The water guiding plates are made preferably of deep drawn or extruded plastic material. The provision of the channel like embossments permits use of thin walled plates. Preferably these plates are made of polystyrol and the wall thickness of the plates is in the range of about 0.2 to 1.0 mm, preferably 0.5 mm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCPIPTION OF THE DRAWING

DESCRIPTION OF THE PREFERRED EMBODIMENTS

Figure 1:
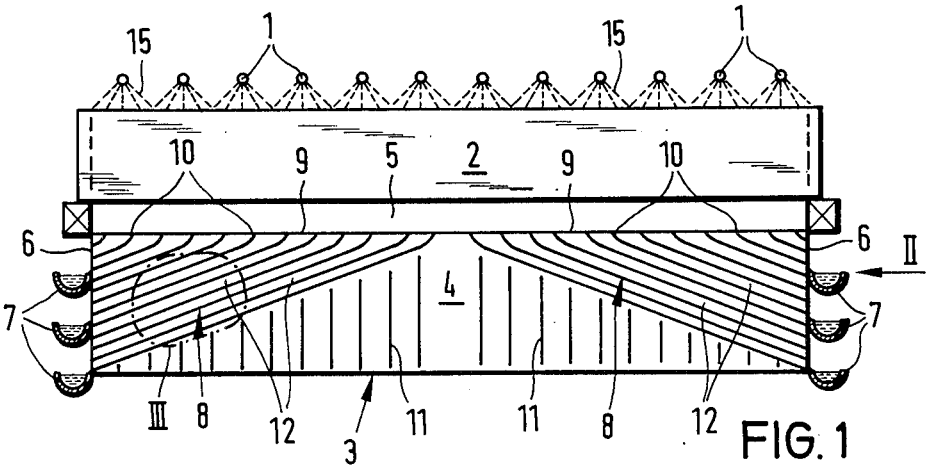
FIG. 1 is a front view of a section schematically illustrating a wet cooling tower in the range of heat exchanging elements.
Figure 2:
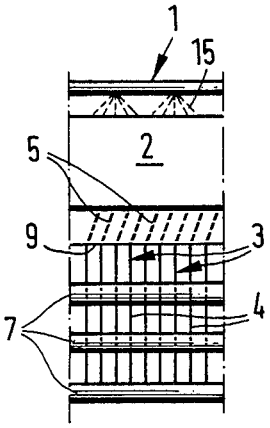
FIG. 2 is a side view of the section of the cooling tower of FIG. 1 viewed in the direction of arrow II.

FIGS. 1 and 2 illustrate a part of a wet cooling tower which includes a water distributing installation 1 arranged on the top of a heat exchanging element 2. The heat exchanging element 2 can be for example a scrubbing installation built in the tower. Immediately below the heat exchanging element a set of water guiding plates 3 is installed. The water guiding plates 3 are arranged in parallel at a small distance one from the other and each defines an upright lower portion 4 and an inclined upper portion 5 joining the lower portion at a substantially horizontal transition region 9. The inclination of the sloping upper portion 5 is such that the gap or clearance between two opposite upright parts of the plates 3 is covered by the upper part so that cooling water after its discharge from the heat exchanging element 2 cannot enter directly the space between the guiding plates.

The water guiding plates 3 consist of a deep drawn or extruded shock proof polystyrol having a wall thickness of about 0.5 mm. The upper surfaces of the plates are coated with a dispersion varnish to improve washability.

In this embodiment, three elongated water collecting channels 7 are arranged in spaced relationship one above the other at both lateral edges of the water guiding plates 3. The channels 7 have open tops so as to collect water from assigned inclined channel like embossments in the vertical part 4 of the plates 3 as it will be explained in greater detail below, and to return the collected water to a non-illustrated return conduit where the water is directly or indirectly recirculated in the water distributing installation 1.

It will be seen from FIG. 1, the upright lower parts 4 of the plates 3 are formed with a plurality of inclined channel like embossments 8 extending from respective lateral edges of the lower part to the transition region 9. Preferably the embossments are inclined at an angle of 20° to a horizontal.

Figure 3:
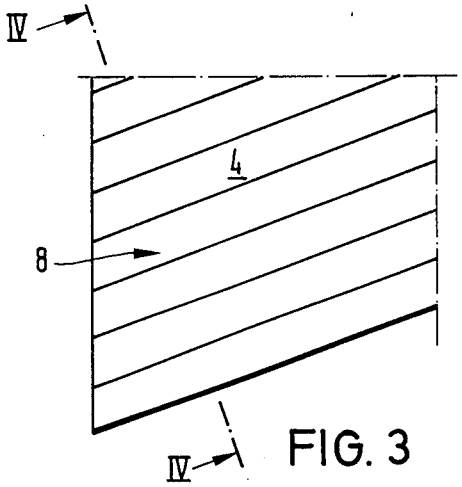
FIG. 3 is a front view of a cut-away part III of FIG. 1, shown on an enlarged scale.
Figure 4:
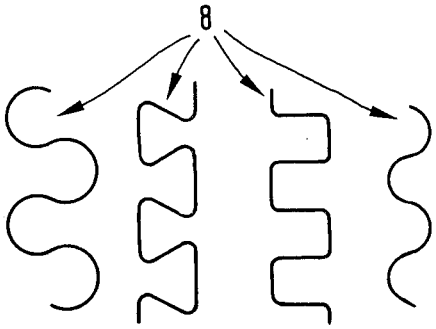
FIG. 4 is a sectional side view of a part of a section of FIG. 3 taken along the line IV—IV and shown on an enlarged scale.

Referring to FIGS. 3 and 4 the vertical cross-section of these channel like embossments can have different forms, e.g. a sinusoidal wave form or a meandering pattern which if desired can be formed with a reverse slope or undercut.

Distributed water 15 falling through the heat exchanger 2 on the sloping upper surfaces 5 of the guiding plates 3 is spread by the effect of its surface tension into a thin layer and reaches the inclined channel-like embossments 8 through the upper end portions 10 of the latter. Preferably, these upper end portions are bent upwardly so as to facilitate the intake of the water layer. The cross-section of the embossments 8 is dimensioned such as to receive an anticipated maximum quantity of incoming water. Due to the reciprocating vertical cross-section of the embossments 8 and due to the surface tension of the water layer the latter is retained in the channel like embossments and is guided in a laminar flow of sorts into the lateral water collecting channels 7.

Reference numeral 11 in FIG. 1 denotes vertical reinforcing ribs formed in the upright portion of the lower part 4 between the inclined embossments 8. The ribs 11 provide for the requisite resistance of the plate against distortion.

Figure 5:
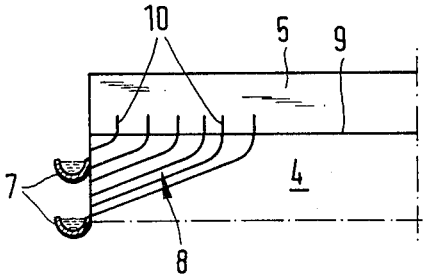
FIGS. 5 and 6 show respectively two modifications of the arrangement of channel-like embossments in the transition region between the sloping upper part and the upright lower part of water guiding plates.
Figure 6:
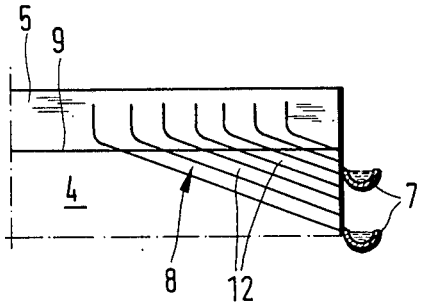

As seen from FIG. 5, the vertically oriented end portions 10 of respective inclined embossments 8 can extend over the transition line 9 in the area of the sloping upper part FIG. 6 shows another modification in which the inclined elongated portions 12 of respective channel like embossments 8 extend over the transition line 9 into the area of the sloping upper part 5.

Figure 7:
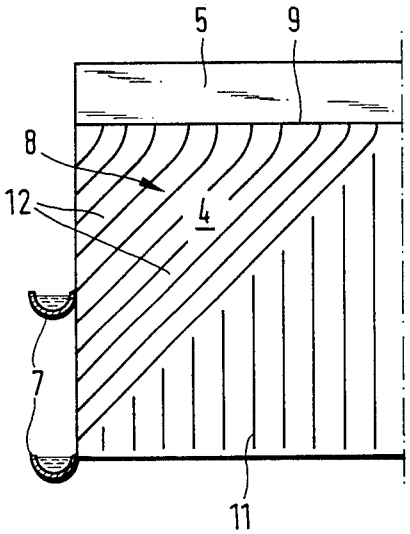
FIGS. 7 and 8 illustrate other embodiments of water guiding plates with embossed channel like structures.
Figure 8:
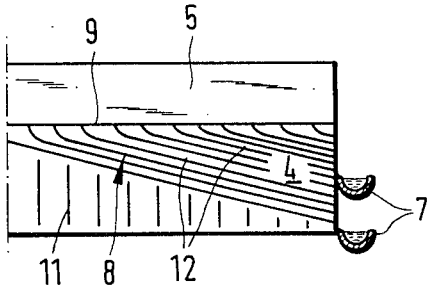

FIG. 7 shows an embodiment of this invention in which the inclined longitudinal sections 12 of the embossments 8 form an angle of 45° to a horizontal. In the modification of FIG. 8, the inclined elongated portions 12 of embossments 8 form an angle of about 16° with the horizontal. In either case, the upright reinforcement ribs are provided in the intermediate region of the upright part 4 between the inclined embossments.

In FIGS. 1, 2 and 5 through 8 the transition region 9 between the upper and lower parts 5 and 4 of the plates 3 forms a sharp edge defining a substantially horizontally oriented transition line. In the embodiment according to FIGS. 9 and 10, this transition region 9 is rounded.

Figure 9:
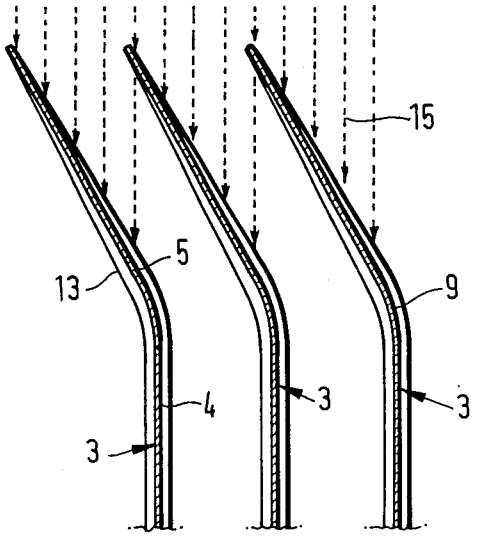
FIG. 9 is a schematic sectional side view of a cutaway part of the array of water guiding plates.
Figure 10:
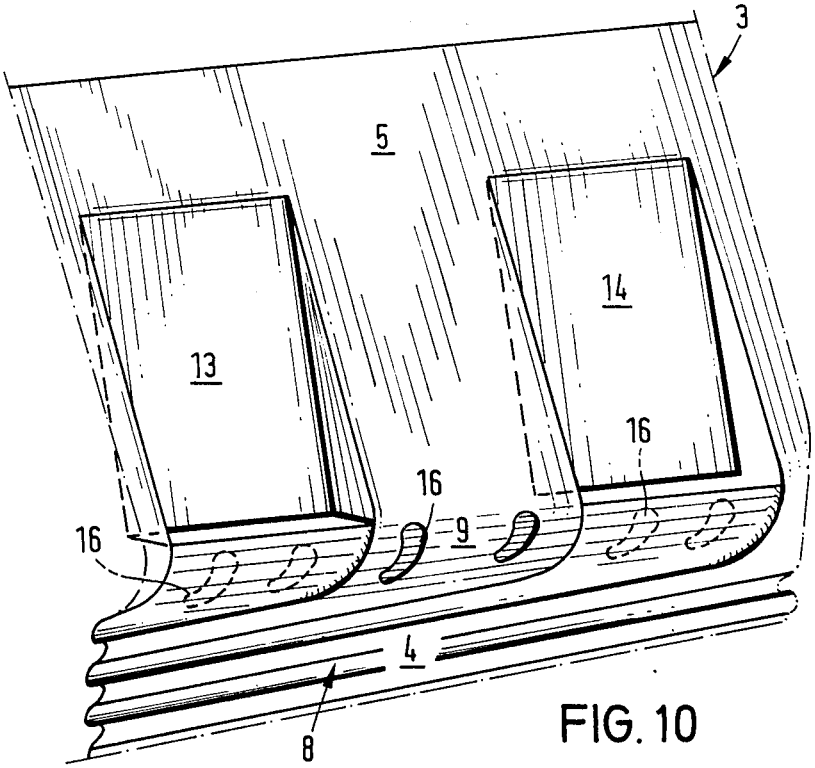
FIG. 10 is a perspective view of a cut-away part of the transition region in a single water guiding plate.

In addition, it will be seen from FIGS. 9 and 10, the region of the sloping upper part 5 adjoining the rounded transition region 9 is formed with openings in the form of inwardly embossed surface portions 13 (left half of FIG. 10) and with upwardly stamped out tongue-like projections 14 (right half of FIG. 10). By means of these depressed and projected embossed areas water layer flowing on the sloping upper part 5 is distributed on both upper surfaces of the water guiding plates 3 so that the latter is wetted from both sides. In addition, improved transfer of water to the respective opposite sides of the upper right part 4 deflecting noses 16 are arranged at both sides of the transition area 9.

It will be understood that each of the elements described above, or two or more together, may also find a useful application in other types of constructions differing from the types described above.

While the invention has been illustrated and described as embodied in a wet type cooling tower, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for transferring cooling water in a wet type or wet/dry type cooling tower, comprising water distributing means, a cooling air heat exchanger arranged below said water distributing means, an array of guiding plates arranged side by side below said cooling air heat exchanger to guide water discharged from the latter, said guiding plates having respectively a sloping upper part and an upright lower part, said lower part joining the upper part at a substantially horizontally directed transition line, at least one set of parallel channel-like embossments formed one above the other in each of said upright lower parts and extending between said transition line and a lateral edge of said lower part, said sloping upper part covering the gap between neighboring guiding plates; and at least one water collecting channel extending transversely relative to said guiding plates at lateral edges of the latter to collect water discharged from said embossments and to transfer the collected water to recirculating means.

2. A device as defined in claim 1, wherein the upper end portions of said channel-like embossments are directed substantially at right angles to said transition line.

3. A device as defined in claim 1, wherein the upper end portions of said channel-like embossments extend in the region of said sloping upper part.

4. A device as defined in claim 1, wherein major parts of said channel-like embossments form an angle between 15° and 45° to the horizontal.

5. A device as defined in claim 4, wherein major parts of said channel-like embossments form an angle of 20° to the horizontal.

6. A device as defined in claim 1, wherein said channel-like embossments are stamped unilaterally in the upright lower part of said guiding plates.

7. A device as defined in claim 1, wherein the vertical cross-section of said channel-like embossments forms a rounded reciprocating pattern.

8. A device as defined in claim 1, wherein the vertical cross-section of said channel-like embossments forms a reciprocating or meandering pattern having sharp corners.

9. A device as defined in claim 1, wherein the vertical cross-section of said channel-like embossments forms a reciprocating pattern with undercut sides.

10. A device as defined in claim 1, wherein at least two water collecting channels are arranged at a distance one above the other at respective upright lower parts of the water guiding plates.

11. A device as defined in claim 1, wherein sections of said sloping upper part of guiding plates adjoining the transition line are formed with downwardly embossed and upwardly stamped openings for directing water to both surfaces of the upright lower parts.

12. A device as defined in claim 1, wherein said transition region between said upper and lower parts is rounded.

13. A device as defined in claim 1, wherein said transition region between said upper and lower parts forms a sharp edge.

14. A device as defined in claim 1, wherein said water guiding plates are made of a deep drawn or extruded plastic material.

15. A device as defined in claim 14, wherein said water guiding plates are made of shock-proof polystyrol.

16. A device as defined in claim 14, wherein said water guiding plates have a wall thickness of about 0.2 to 1.0 mm.

17. A device as defined in claim 14, wherein said water guiding plates have a wall thickness of about 0.5 mm.

18. A device as defined in claim 1, wherein upper surfaces of said water guiding plates are coated with a varnish for improving wettability of these surfaces.

19. A device as defined in claim 1, wherein the transition region between the upper and lower parts of said water guiding plates is provided at both sides thereof with diverting elements for evenly dstributing water on said upright lower parts.

* * * * *